US012796749B2

(12) United States Patent
DeFrancesco-Sias et al.

(10) Patent No.: US 12,796,749 B2
(45) Date of Patent: Nov. 17, 2026

(54) WEARABLE HANDKERCHIEF SYSTEM

(71) Applicant: TUCKERCHIEF LLP, Killington, VT (US)

(72) Inventors: Kate DeFrancesco-Sias, Killington, VT (US); Michelle Blackburn, Killington, VT (US)

(73) Assignee: TUCKERCHIEF LLP, Killington, VT (US)

( * ) Notice: Subject to any disclaimer, the term of this patent is extended or adjusted under 35 U.S.C. 154(b) by 0 days.

(21) Appl. No.: 18/732,189

(22) Filed: Jun. 3, 2024

(65) Prior Publication Data

US 2024/0398045 A1 Dec. 5, 2024

Related U.S. Application Data

(60) Provisional application No. 63/470,645, filed on Jun. 2, 2023.

(51) Int. Cl.
*A41B 15/00* (2006.01)

(52) U.S. Cl.
CPC ..... *A41B 15/00* (2013.01)

(58) Field of Classification Search
CPC ..... A41D 19/0024; A41D 19/0044; A41D 13/088; A41D 20/00; A63B 21/4021; A61F 5/05866; Y10S 2/91; Y10S 2/917
See application file for complete search history.

(56) References Cited

U.S. PATENT DOCUMENTS 1,934,332 A * 11/1933 Skinner ..... A41D 19/0044 D2/621
3,594,819 A * 7/1971 Mullins ..... A41B 7/00 2/170
4,244,057 A * 1/1981 Burnham ..... A41D 19/0037 2/160
4,462,116 A * 7/1984 Sanzone ..... A41D 20/00 2/253
4,536,889 A * 8/1985 Taylor ..... A44C 5/0046 2/160
4,757,556 A * 7/1988 Girard ..... A41D 19/01594 2/160
4,832,010 A * 5/1989 Lerman ..... A61F 2/7812 2/24
4,843,645 A * 7/1989 White ..... A41D 13/08 2/917
4,843,653 A * 7/1989 Coble ..... D04B 1/22 2/169
4,856,112 A * 8/1989 Effle ..... A41D 13/08 D2/612
4,884,297 A * 12/1989 Triche ..... A41D 13/08 2/268

(Continued)

*Primary Examiner* — Jillian K Pierorazio
(74) *Attorney, Agent, or Firm* — Volpe Koenig

(57) ABSTRACT

A wearable handkerchief cuff designed to be worn on the wrist and an embedded wearable handkerchief system that integrates a removable fabric piece with gloves or mittens are disclosed. The wearable handkerchief cuff is made of fabric and features a tubular body with specific designs at the wrist and finger ends, additional absorbent materials, and various closure mechanisms. The embedded wearable handkerchief system allows for the removable attachment of a fabric piece to gloves or mittens via corresponding attachment points.

5 Claims, 7 Drawing Sheets

(56) References Cited

U.S. PATENT DOCUMENTS 4,896,378 A * 1/1990 Campana ..... A41D 20/00 2/910
4,933,992 A * 6/1990 Kallman ..... A41D 19/00 2/160
5,003,637 A * 4/1991 Lonon ..... A41D 19/0024 2/160
5,070,544 A * 12/1991 Aliberti ..... A41B 7/00 2/232
5,116,057 A * 5/1992 Mangiaracina .... A63B 21/4021 473/409
5,168,577 A * 12/1992 Detty ..... A41D 13/065 2/24
5,329,638 A * 7/1994 Hansen ..... A41D 13/088 2/16
5,445,383 A * 8/1995 Gleason, Jr. ..... A63B 69/3608 273/DIG. 30
5,542,121 A * 8/1996 Lahaussois ..... A41D 13/08 2/16
5,706,521 A * 1/1998 Haney ..... A41D 19/0024 2/160
5,734,992 A * 4/1998 Ross ..... A41D 13/08 2/161.7
6,023,786 A * 2/2000 Burnett ..... A44C 5/00 2/21
6,092,235 A * 7/2000 Santa Cruz ..... A41D 13/08 2/93
6,280,529 B1 * 8/2001 Meyer ..... A61C 19/005 15/210.1
6,449,772 B1 * 9/2002 Donner ..... A41D 13/088 2/16
6,694,519 B1 * 2/2004 Stewart ..... A41D 13/088 602/21
6,739,160 B1 * 5/2004 Hiraga ..... D04B 1/106 66/170
6,760,924 B2 * 7/2004 Hatch ..... A41D 19/01505 2/163
6,813,779 B1 * 11/2004 Williams ..... A41D 13/08 2/16
7,200,870 B1 * 4/2007 Kolk ..... A41D 13/08 2/167
D549,885 S * 8/2007 Van Trojen ..... D29/120.1
D599,961 S * 9/2009 Arshadi ..... D29/122
D621,554 S * 8/2010 Price ..... D2/610
8,356,362 B1 * 1/2013 Robertson ..... H04B 1/385 2/16
D787,153 S * 5/2017 Solsona ..... D2/610
D954,389 S * 6/2022 Tatiyatrairong ..... D2/617
2005/0229284 A1 * 10/2005 Gaetz ..... A41D 19/01594 2/159
2007/0119462 A1 * 5/2007 Shumate ..... A41D 13/08 128/846
2007/0234466 A1 * 10/2007 Stengel ..... A41D 20/00 2/160
2008/0235846 A1 * 10/2008 Schossberger ..... A41D 13/088 2/170
2009/0151045 A1 * 6/2009 Hinds ..... A41D 20/00 2/170
2011/0016610 A1 * 1/2011 Wieder ..... A41D 20/00 2/170
2012/0066810 A1 * 3/2012 Marcus ..... A41D 19/01529 2/16
2012/0115624 A1 * 5/2012 Baer, Jr. ..... A63B 69/3608 473/409
2012/0311766 A1 * 12/2012 Clark ..... A41D 19/01 2/158
2014/0082825 A1 * 3/2014 Clark ..... A41D 19/01 2/158
2014/0157475 A1 * 6/2014 Smith ..... A41D 19/0044 2/16
2015/0067975 A1 * 3/2015 Lee ..... A47L 17/00 15/210.1
2015/0101094 A1 * 4/2015 Hinds ..... A41D 13/08 2/16
2016/0029719 A1 * 2/2016 Morris ..... A63B 71/145 2/160
2016/0100639 A1 * 4/2016 Sheedy ..... A41D 20/00 2/170
2016/0262465 A1 * 9/2016 Vito ..... A41D 13/088
2016/0262470 A1 * 9/2016 Blythe ..... D04B 1/12
2016/0302498 A1 * 10/2016 Kreft ..... A41D 19/0017
2017/0135426 A1 * 5/2017 Rivera ..... A41D 27/10
2018/0014587 A1 * 1/2018 Enderlin ..... A41D 27/285
2018/0049491 A1 * 2/2018 Cook ..... A41D 19/01523
2018/0279700 A1 * 10/2018 Huber ..... A41D 13/081
2021/0076761 A1 * 3/2021 Mamedova ..... A41D 20/00
2022/0047024 A1 * 2/2022 Mayo ..... A41D 31/125
2024/0057699 A1 * 2/2024 Geiger ..... A41D 13/08
2024/0341509 A1 * 10/2024 Rubin ..... A41D 20/00
2024/0423302 A1 * 12/2024 Aihara ..... A41D 13/0015

* cited by examiner

WEARABLE HANDKERCHIEF SYSTEM

CROSS REFERENCE TO RELATED APPLICATIONS

This application claims the benefit of U.S. provisional application No. 63/470,645 filed on Jun. 2, 2023, which is incorporated by reference as if fully set forth.

FIELD OF THE INVENTION

The present application relates to wearable, reusable tissues or handkerchiefs, of which there are none currently.

BACKGROUND OF THE INVENTION

Traditional handkerchiefs provide necessary implements to blow, wipe, and clean one's nose and face. Traditional handkerchiefs went out of style ages ago, however, with the renewed spirit of reusable items, thereby creating less waste; the reusable handkerchief is making its return. Traditional handkerchiefs are usually large squares of fabric, requiring a large pocket or bag for storage. Traditional handkerchiefs are not stylish, and are often misplaced or lost. Traditional handkerchiefs are notorious for their large, unwieldy, and gross nature; additionally there are many applications in which the prevailing substitute, disposable tissues, are not practical. Alternatives to handkerchiefs include wiping one's nose on their, glove, mitten, jacket sleeve, or shirt hem, and blowing mucus and saliva on the ground. None of these solutions are hygienic or socially acceptable. Accordingly, there is a need for a sustainable, efficient, streamlined, stylish, handkerchief that is easily transported or carried without requiring a pocket or bag.

SUMMARY OF THE INVENTION

A wearable handkerchief cuff designed to be worn on the wrist and an embedded wearable handkerchief system that integrates a removable fabric piece with gloves or mittens are disclosed. The wearable handkerchief cuff is made of fabric and features a tubular body with specific designs at the wrist and finger ends, additional absorbent materials, and various closure mechanisms. The embedded wearable handkerchief system allows for the removable attachment of a fabric piece to gloves or mittens via corresponding attachment points.

Figure 1A:
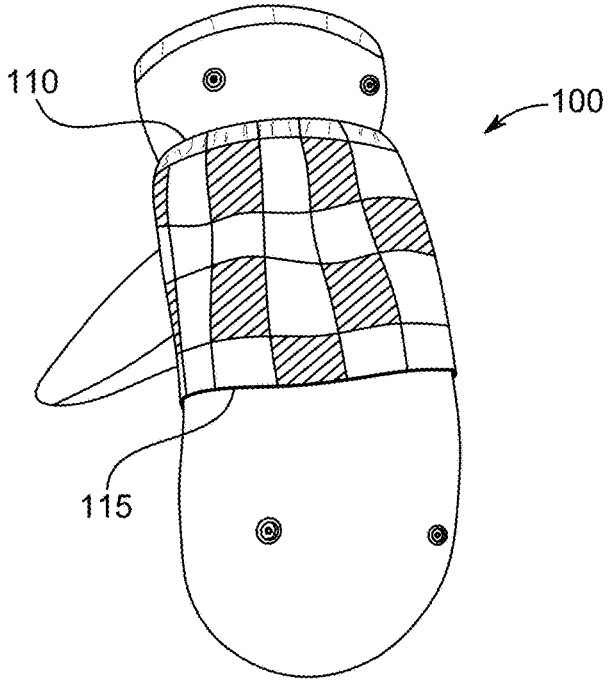
FIG. 1A is a top view of the over glove/mitten elongated version with basic features.

Throughout the drawings, the same reference numerals and characters, unless otherwise specified, are used to denote like features, elements, components or portions of the illustrated embodiments. Furthermore, while the present disclosure will now be described in detail with reference to the figures, it is done so in connection with the illustrative embodiments. It is intended that changes and modifications may be made to the described embodiments without departing from the true scope and spirit of the present disclosure.

DETAILED DESCRIPTION OF THE PREFERRED EMBODIMENTS

The present embodiments provide a wearable handkerchief made of fabric with the ability to wear the handkerchief as a wrist or partial hand-covering or cuff. In some embodiments the cuff may be used and then tucked under or into itself, thereby permitting the user to use it multiple times over the course of the day or sports activity. Wearable handkerchiefs permit the freedom of movement especially during sport and exercise. Wearable handkerchiefs eliminate the need to fish around in pockets or bags for paper tissues, or traditional handkerchiefs. This is advantageous for those with physical disabilities that may have difficulty taking items in and out of their pockets, or in extreme cold weather where protecting hands in winter gloves, is critical, or when operating sports equipment such as bicycles where it difficult to take ones hand off of the handle bars long enough to retrieve a handkerchief from a pocket. Further, by providing easy access to handkerchief, the wearable handkerchief may help protecting people's faces who attempt to go 'without', as well as reducing waste left by people who carry paper tissues.

FIG. 1A depicts the top view of an over glove/mitten elongated tubular cuff (100). This cuff 100 includes a wrist-end elastic seam, or synch, (110) to provide a snug fit around the wrist, and a finger-end straight stitched seam (115) ensuring the end of the cuff is sturdy but does not restrict a user's finger movement. Alternatively, the seam (115) may include elastic or a synch for a more secure fit. A thumb hole (120) helps to secure or anchor the cuff 100 in proper orientation and allows for thumb movement. The thumb hole 120 may be sized to accommodate the user's bare thumb, or the thumb of a mitten or glove. In some embodiments the thumb hole may include a separate closure in the inside of the thumb joint. The overall shape of the tubular cuff 100 may be contoured to be right or left-hand specific, with exposed fingers, or mitten.

Figure 1B:
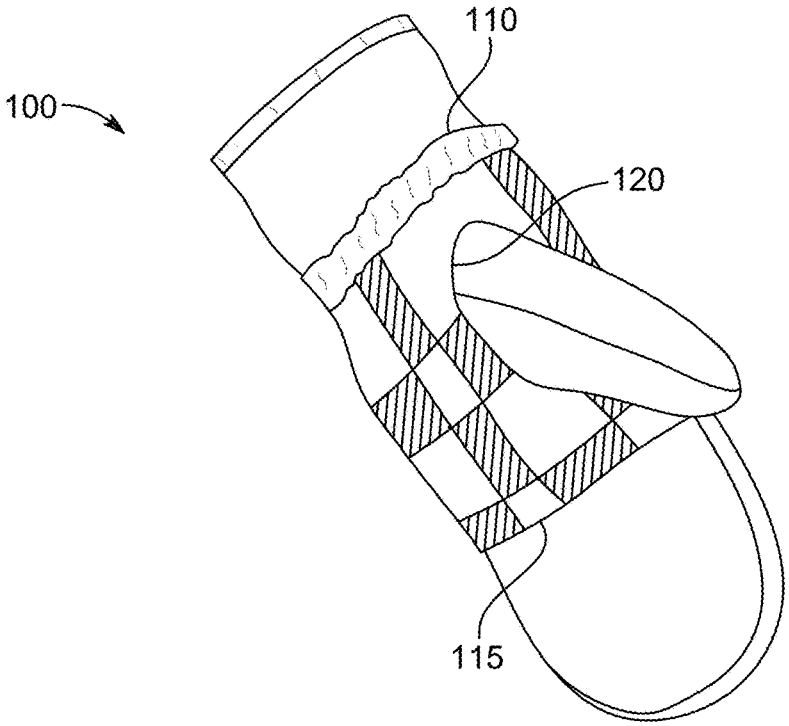
FIG. 1B is a bottom view of an over glove/mitten elongated cuff.

FIG. 1B shows the bottom view of the of an over glove/mitten elongated tubular cuff (100), mirroring the components seen in FIG. 1A.

Figure 1C:
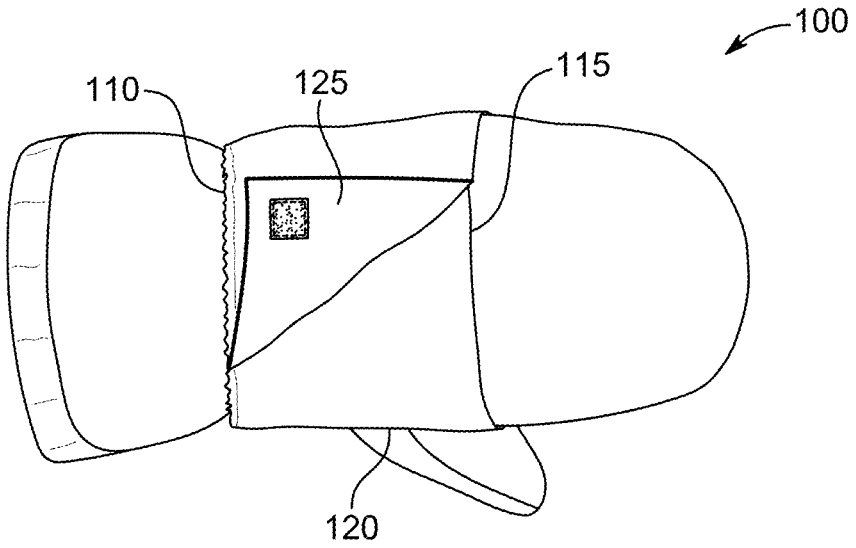
FIG. 1C is a top view of an over glove/mitten elongated cuff with an optional flap open.

FIG. 1C illustrates the top view with an optional flap (125) in the open position. The optional flap (125) on the back of the cuff 100 can provide additional material, cover soiled areas, or protect a clean wiping cloth. The flap (125) may include one of various closing mechanisms (130) such as snap, magnet, hook and loop fasteners, or buttons.

Figure 1D:
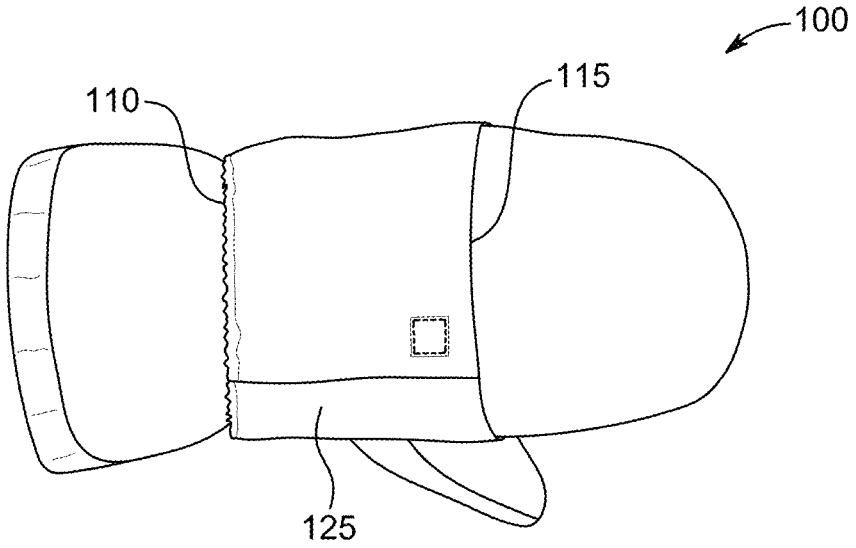
FIG. 1D is a top view of an over glove/mitten elongated cuff with the optional flap closed.

FIG. 1D shows the top view with the optional flap (125) closed.

It should be noted that the cuff 100, may include a second opening (not shown) to accommodate snap-in ski pole retaining clips or straps.

Figure 2A:
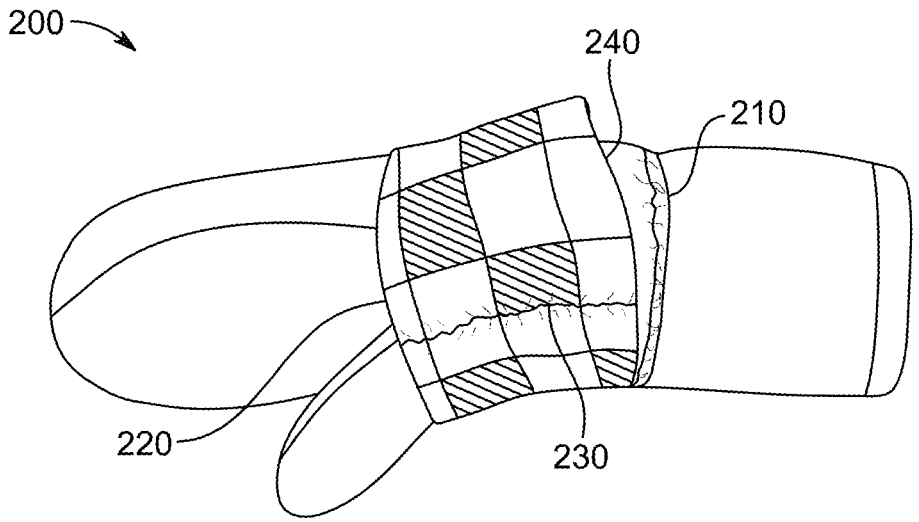
FIG. 2A is a side view of a short wearable handkerchief cuff.
Figure 2B:
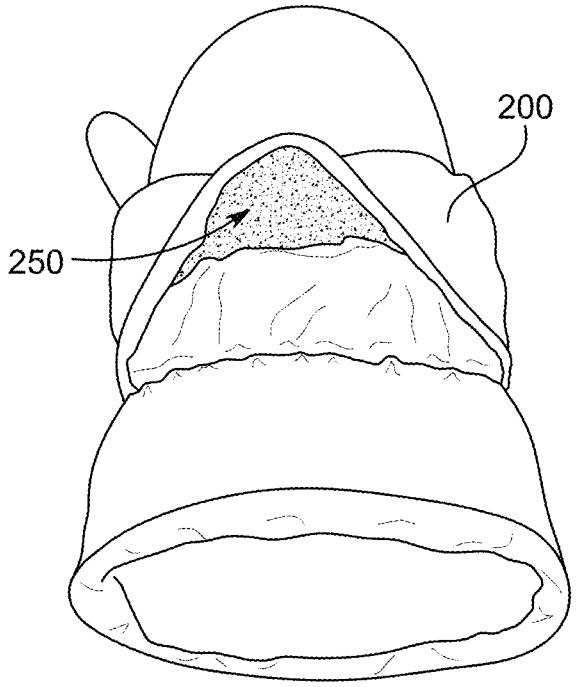
FIG. 2B is a perspective view of a short wearable handkerchief cuff.

FIG. 2A and FIG. 2B present a short embodiment of the wearable handkerchief cuff (200). This provide a snug fit around the wrist, and a finger-end stitched seam (220) ensuring the end of the cuff is sturdy but does not restrict a user's finger movement. The cuff 200 does not include a thumb hole and is not hand-specific. Optional features include a longitudinal seam (230). The longitudinal seam 230, may use ruching to gather additional material, and the fabric can be doubled over to make it two-ply and reversible (240). The cuff is configured to accept wearable ski pole retaining clips or straps, and may include a soft, absorbent inner layer (250) for comfort.

Figure 3:
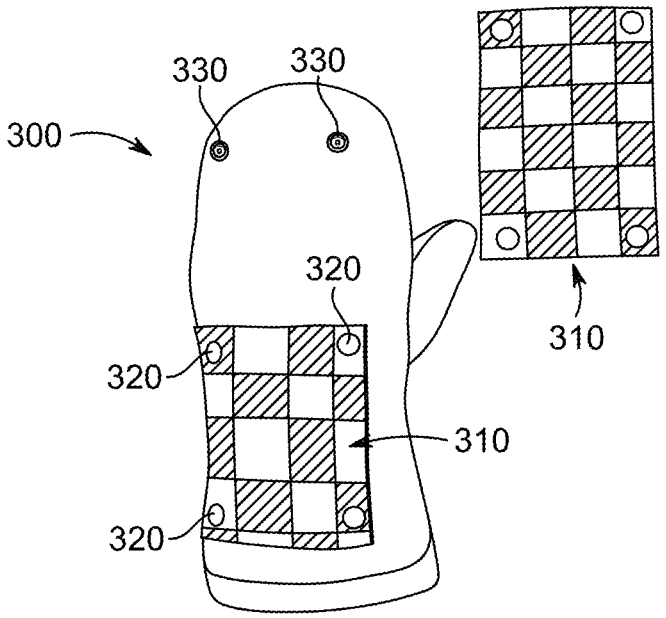
FIG. 3 is a top view of an embedded handkerchief using detachable fabric.

FIG. 3 illustrates the embedded handkerchief system (300) with detachable fabric (310) that can be washed separately or replaced. Attachment points (320) embedded in the glove or mitten allow for easy attachment, and these points can include snaps, buttons, magnets, hook and loop fasteners, or zippers. Additional attachment points (330) may be embedded in the glove or mitten to allow placement closer to the wrist or fingers. The fabric can also feature ruching for additional material and be made two-ply and reversible. Disposable or single-use and biodegradable options are also included within the scope of the present application.

Figure 4:
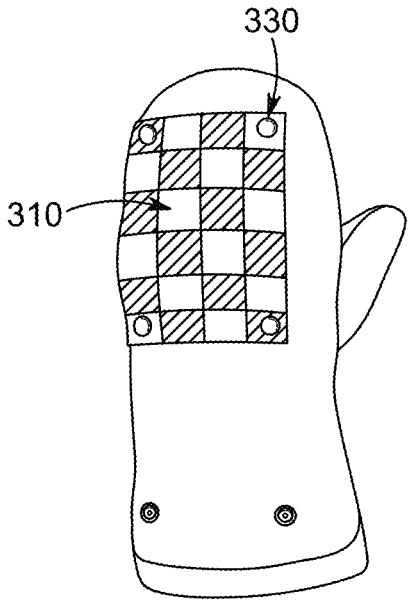
FIG. 4 is a perspective view of the embedded handkerchief installed in an alternate location.

FIG. 4 shows the embedded handkerchief system (300) installed in an alternate location using the additional attachment points (330).

FIGS. 5A through 5F display various views of the detachable cuff (500), which includes a closing mechanism and fold pattern or pleats to provide additional material, designed to store flat. The closure around the wrist enables the cuff 500 to be worn without concern of it sliding off over the hand. The closure allows the cuff 500 to be worn on the wrist, but it is also possible to wear the cuff 500 around an ankle, or to attach around an object, such as a ski pole or bike frame. This allows the user to use the wearable handkerchief and for it to be immediately accessible, without the necessity of a pocket or other carrying item.

Figure 5A:
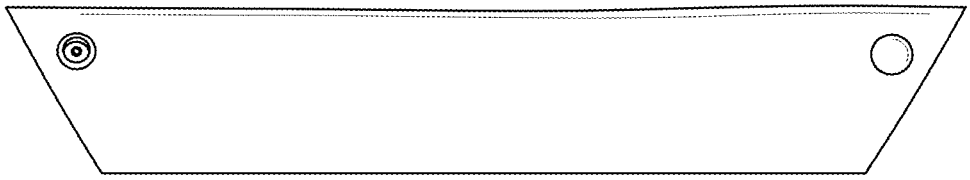
FIG. 5A-F shows various views of another detachable cuff.
Figure 5B:
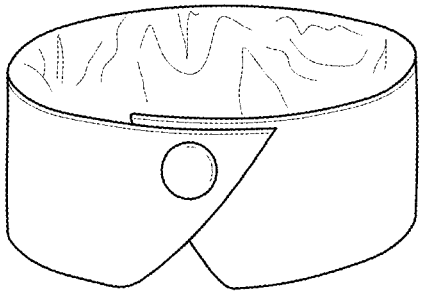
Figure 5C:
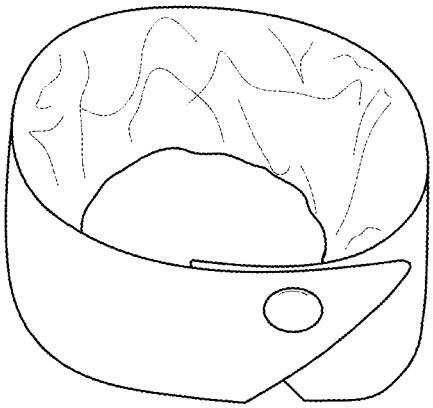
Figure 5D:
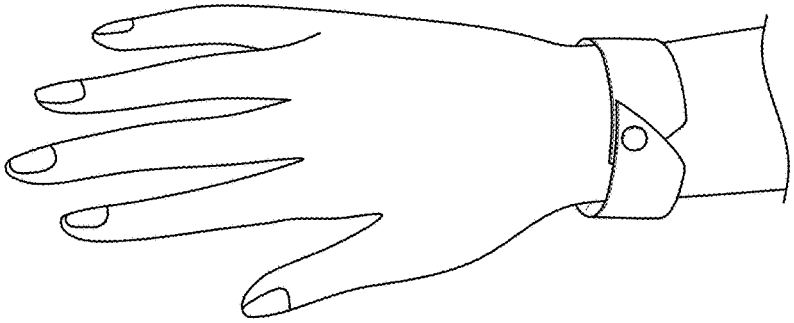
Figure 5E:
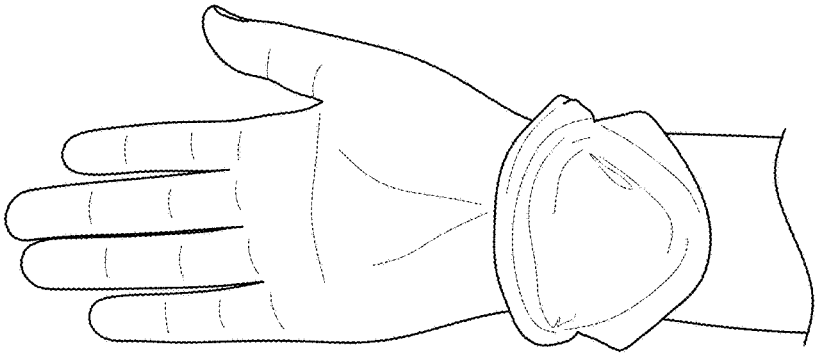
Figure 5F:
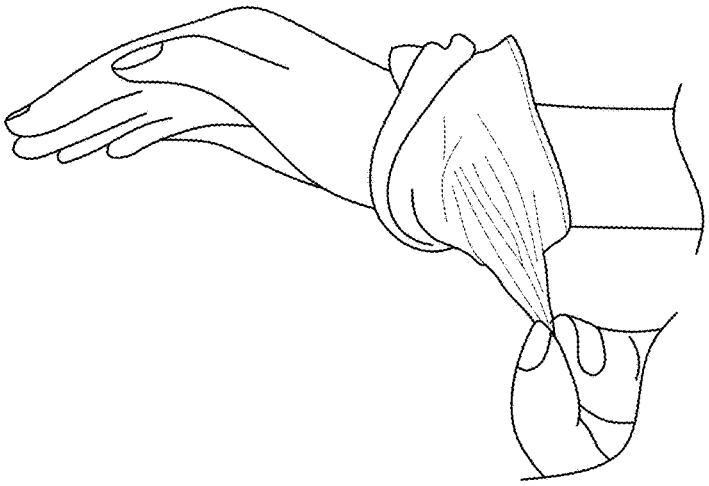

It should be noted that FIG. 5A shows the cuff 500 in an open form before being attached the user's wrist. It should be noted that in the open form the wearable handkerchief lays flat making it convenient for storage or packing.

Figure 6A:
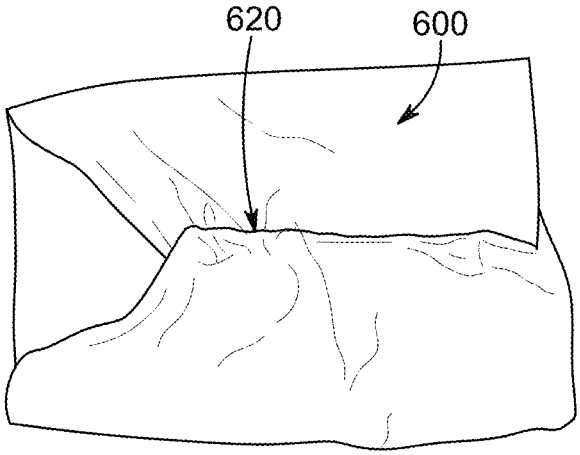
FIG. 6A is a top view of a removable cuff of a tubular design.
Figure 6B:
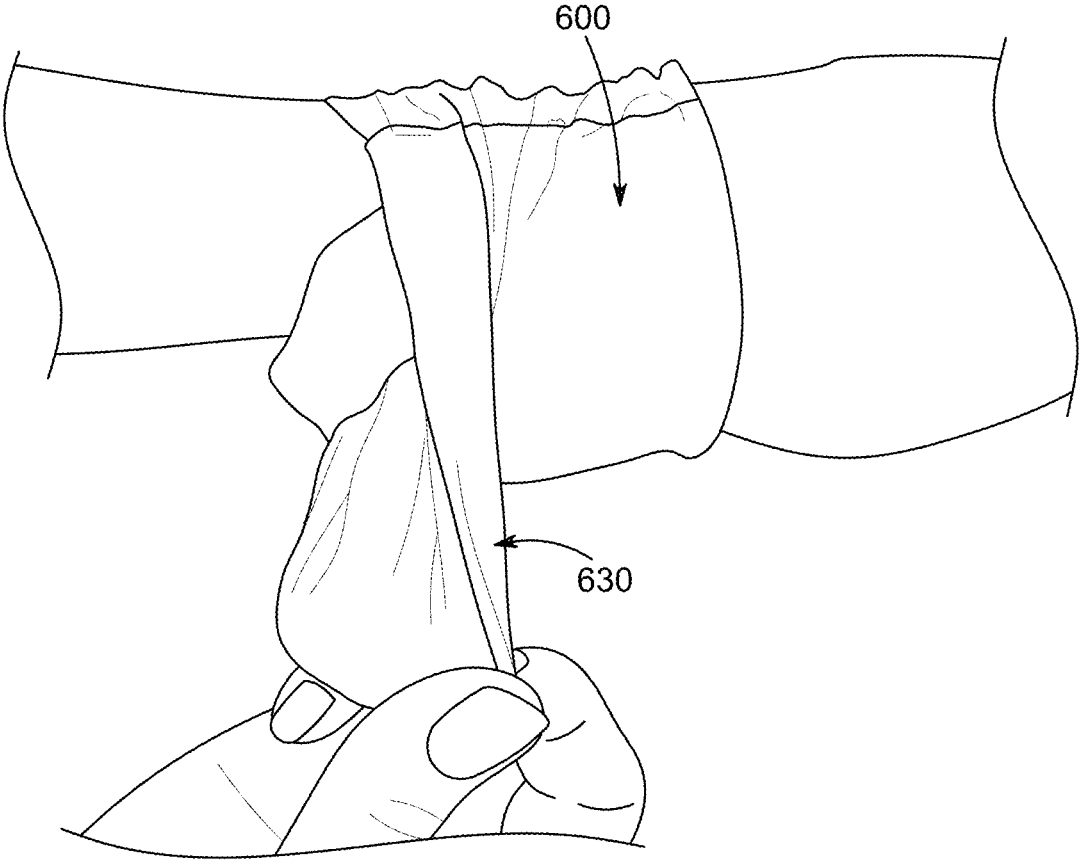
FIG. 6B is a perspective view of the cuff of a tubular design showing additional layers of material.

FIGS. 6A and 6B illustrate a removable tubular cuff (600). The cuff 600 features a tubular design that slides on and off the wrist easily. Optional ruching (620) on a longitudinal seam may provide additional material efficiently, and a stitched seam (610) on the hand end ensures that the cuff 600 remains sturdy without restricting the users finger movement. Fold patterns or pleats (630) are used to provide additional material for absorption of fluids in an efficient manner. The cuff 600 may be a tubular fabric structure with, or without a thumb hole, and sized to wear snuggly on the user's wrist with minimal effort, and no tying or special folding required.

In operation a user may use any of the cuffs of FIGS. 1A-6B in the normal way one wipes or blows one's nose. The user may use the inside, underside, or outside of the wearable handkerchief at their discretion.

Any of the cuffs (100-600) of FIG. 1A-6B provide an improved handkerchief, by increasing the accessibility of a handkerchief or tissue, reducing waste with its reusability, and providing a more user friendly, yet economical handkerchief.

Any of the cuffs (100-600) of FIG. 1A-6B may be made from a fabric that is some combination of soft, absorbent, antimicrobial, sustainable, reusable, washable, fashionable, light weight, breathable, self-drying, moisture wicking, stretchy or elastic, single layer, or double layer. It should also be noted that in many instances it may be desirable to use a combination of different fabrics for different parts of a single cuff. For example, it may be desirable to have stylish printed pattern on the outside of a cuff, with a thicker more absorbent materials hidden inside the cuff for better liquid absorption.

Any of the cuffs (100-600) of FIG. 1A-6B may include specific shapes. For example, the shape may be configured to be contoured to a user's bare hand or contoured to a mitten or glove. While several of the cuffs are described as "tubular" this may include tubes that are rounded, squared, triangular, cylindrical, or any other shape.

Different closures and attachment mechanisms are contemplated. These include, but are not limited to: buttons, snaps, clips, stitches, magnets, continuous fabric tubes, hook-and-loop, zipper, lace up. It should also be noted that various combinations of these closure and attachment mechanisms may be used on a single cuff.

Accordingly several advantages are to provide an improved handkerchief, to provide means of increasing the accessibility of a handkerchief or tissue, reduce waste with its reusability, and provide a more user friendly, yet economical handkerchief. Still further advantages will become apparent from a study of the following description and the accompanying drawings.

What is claimed is:

1. A wearable handkerchief cuff comprising:

a flexible tubular body formed of an absorbent fabric material and sized to fit snugly around a user's wrist, the tubular body having a wrist end and finger end, wherein the wrist end comprises an elastic seam or cinch, and the finger end comprises a straight stitched seam, wherein the tubular body further comprises a longitudinal seam that gathers additional material of the absorbent fabric material to provide additional absorbent material for absorption of fluid, wherein the absorbent fabric material is configured to present an exposed surface for wiping fluid from a user's skin or nose while the handkerchief cuff is worn on the wrist.

2. The wearable handkerchief cuff of claim 1 wherein the tubular body is two ply material, and is reversible.

3. The wearable handkerchief of claim 1 wherein the tubular body is comprised of two different types of material, including a first type which is the absorbent fabric material.

4. The wearable handkerchief cuff of claim 1, wherein the absorbent fabric material comprises a soft, breathable, self-drying, moisture-wicking, stretchy, or elastic fabric.

5. The wearable handkerchief cuff of claim 1, wherein the tubular body includes a two-ply construction with an absorbent inner layer.

* * * * *